US010249994B2

(12) United States Patent
Foran

(10) Patent No.: US 10,249,994 B2
(45) Date of Patent: Apr. 2, 2019

(54) CONNECTOR HAVING PLURAL CONTACTS FORMING DIFFERENTIAL PAIRS AND CONNECTOR DEVICE USING THE SAME

(71) Applicant: HIROSE ELECTRIC CO., LTD., Tokyo (JP)

(72) Inventor: Thomas Foran, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/896,515

(22) Filed: Feb. 14, 2018

(65) Prior Publication Data

US 2018/0248322 A1 Aug. 30, 2018

(30) Foreign Application Priority Data

Feb. 27, 2017 (JP) ..... 2017-034568

(51) Int. Cl.

| | |
|---|---|
| ***H01R 24/00*** | (2011.01) |
| ***H01R 24/40*** | (2011.01) |
| ***H01R 24/86*** | (2011.01) |
| *H01R 107/00* | (2006.01) |
| *H01R 13/645* | (2006.01) |

(52) U.S. Cl.

CPC ..... *H01R 24/40* (2013.01); *H01R 24/005* (2013.01); *H01R 24/86* (2013.01); *H01R 13/645* (2013.01); *H01R 2107/00* (2013.01); *H01R 2201/04* (2013.01)

(58) Field of Classification Search

CPC ..... H01R 24/40; H01R 24/005; H01R 24/86; H01R 2201/04

USPC ..... 439/676

See application file for complete search history.

(56) References Cited

U.S. PATENT DOCUMENTS

2009/0233475 A1* 9/2009 Mildon et al. ..... H01R 9/035 439/277

FOREIGN PATENT DOCUMENTS

JP 2013-004281 1/2013

* cited by examiner

*Primary Examiner* — Abdullah A Riyami
*Assistant Examiner* — Nelson R. Burgos-Guntin
(74) *Attorney, Agent, or Firm* — Rankin, Hill & Clark LLP

(57) ABSTRACT

A plurality of contacts form a plurality of differential pairs between adjacent contacts of the plurality of contacts. Contact portions of contacts of the plurality of contacts forming each of at least three differential pairs of the plurality of differential pairs are located in a vertical direction at positions at one side in the vertical direction in a plane orthogonal to the axial direction. Also, the at least three differential pairs are arranged in parallel to one another in a state separated from one another by equal distances in a horizontal direction in the orthogonal plane. Contact portions of contacts of the plurality of contacts forming another differential pair other than the at least three differential pairs are located in the horizontal direction at positions at the other side in the vertical direction in the orthogonal plane.

18 Claims, 5 Drawing Sheets

CONNECTOR HAVING PLURAL CONTACTS FORMING DIFFERENTIAL PAIRS AND CONNECTOR DEVICE USING THE SAME

BACKGROUND OF THE INVENTION

1. Field of the Invention

The present invention relates to a connector having a plurality of contacts forming differential pairs, and a connector device using the connector.

2. Description of the Related Art

A connector having a plurality of contacts forming differential pairs has been developed as a connector used for a local area network (LAN) cable. However, this type of connector may have a problem in which insertion loss increases due to crosstalk as the speed and distance of the network increases. Japanese Unexamined Patent Application Publication No. 2013-4281 shows an arrangement example of contacts for effectively addressing the problem, or more particularly an arrangement example of contacts in a connector having a plurality of contacts forming differential pairs.

The standards of IEEE etc. define various communication standards relating to LAN cables. The LAN cables are classified into categories in accordance with the communication standards. Even cables belonging to the same category may have markedly different communication performances depending on the arrangements of contacts connected to the cables as is known.

SUMMARY OF THE INVENTION

It is an object of this application to provide a connector and a connector device having good electrical characteristics by employing an array for effectively reducing the influence of crosstalk for a plurality of contacts forming differential pairs.

To effectively reduce the influence of crosstalk, under the findings that it is necessary to separate differential pairs from one another as much as possible in a limited space, and it is necessary to prevent certain differential pairs from being excessively close to one another, various simulations have been performed, and a differential pair or a method of arraying contacts that can further effectively reduce crosstalk has been found.

(1) To address the above-described problem, a connector according to an aspect of the present invention includes a plurality of contacts having a plurality of contact portions extending in an axial direction in a one-to-one correspondence; and a housing having an inner wall extending in the axial direction. Outer peripheries of the plurality of contact portions are substantially covered with the inner wall. An insertion portion in which a plurality of counterpart contacts capable of contacting the plurality of contact portions in a one-to-one correspondence are arranged is inserted in the axial direction into an insertion space defined by the inner wall. The plurality of contacts form a plurality of differential pairs between adjacent contacts of the plurality of contacts. Contact portions of contacts of the plurality of contacts forming each of at least three differential pairs of the plurality of differential pairs are located in a vertical direction at positions at one side in the vertical direction in a plane orthogonal to the axial direction. The at least three differential pairs are arranged in parallel to one another in a state separated from one another by equal distances in a horizontal direction in the orthogonal plane. Contact portions of contacts of the plurality of contacts forming another differential pair other than the at least three differential pairs of the plurality of differential pairs are located in the horizontal direction at positions at the other side in the vertical direction in the orthogonal plane.

(2) Also, to address the above-described problem, a connector according to another aspect of the present invention includes a plurality of contacts having a plurality of contact portions extending in an axial direction in a one-to-one correspondence; and a housing having an insertion portion extending in the axial direction, the plurality of contact portions being arranged in the insertion portion. The insertion portion is inserted in the axial direction into an insertion space defined by an inner wall extending in the axial direction to substantially cover outer peripheries of contact portions of a plurality of counterpart contacts capable of contacting the plurality of contact portions in a one-to-one correspondence. The plurality of contacts form a plurality of differential pairs between adjacent contacts of the plurality of contacts. Contact portions of contacts of the plurality of contacts forming each of at least three differential pairs of the plurality of differential pairs are located in a vertical direction at positions at one side in the vertical direction in a plane orthogonal to the axial direction. The at least three differential pairs are arranged in parallel to one another in a state separated from one another by equal distances in a horizontal direction in the orthogonal plane. Contact portions of contacts of the plurality of contacts forming another differential pair other than the at least three differential pairs of the plurality of differential pairs are located in the horizontal direction at positions at the other side in the vertical direction in the orthogonal plane.

Preferably, in the connector according to the above-described aspect, a cross section of the insertion space and a cross section of the insertion portion both have substantially circular shapes in the orthogonal plane.

Preferably, in the connector according to the above-described aspect, the contacts forming the at least three differential pairs are separated from one another by equal distances in the vertical direction.

Preferably, in the connector according to the above-described aspect, differential pairs located at left and right sides in the horizontal direction of the at least three differential pairs are located at the same height in the vertical direction.

Preferably, in the connector according to the above-described aspect, a differential pair located at the center in the horizontal direction of the at least three differential pairs is located at a position at the one side in the vertical direction with respect to differential pairs located at left and right sides in the horizontal direction of the at least three differential pairs.

Preferably, in the connector according to the above-described aspect, an imaginary line passing through the centers of contacts of the plurality of contacts forming a differential pair located at the center in the horizontal direction of the at least three differential pairs passes through the center in the horizontal direction of the contacts forming the other differential pair.

Preferably, in the connector according to the above-described aspect, a contact located at a position at the other side in the vertical direction of contacts of the plurality of contacts forming a differential pair located at the center in the horizontal direction of the at least three differential pairs is located at the same height in the vertical direction as a height of a contact arranged at a position at the one side in the vertical direction of contacts of the plurality of contacts forming each of differential pairs located at left and right sides in the horizontal direction of the at least three differential pairs.

Preferably, in the connector according to the above-described aspect, the contacts are contacts compliant with Category 5e and are eight in total.

Further, to address the above-described problem, a connector device according to still another aspect of the present invention includes the connector described in aforementioned (1) and the connector described in aforementioned (2).

Preferably, the connector device according to the above-described aspect includes the above-described contacts.

With the present invention, in the plurality of contacts forming the differential pairs, the connector and the connector device having good electrical characteristics can be provided by employing the array for effectively reducing the influence of crosstalk for the plurality of contacts forming the differential pairs.

DESCRIPTION OF THE PREFERRED EMBODIMENTS

A preferred embodiment of the present invention is described below with reference to the accompanying drawings. It is to be noted that only the preferred embodiment is described below for the convenience of description; however, it is not intended to limit the present invention by the preferred embodiment.

Figure 1:
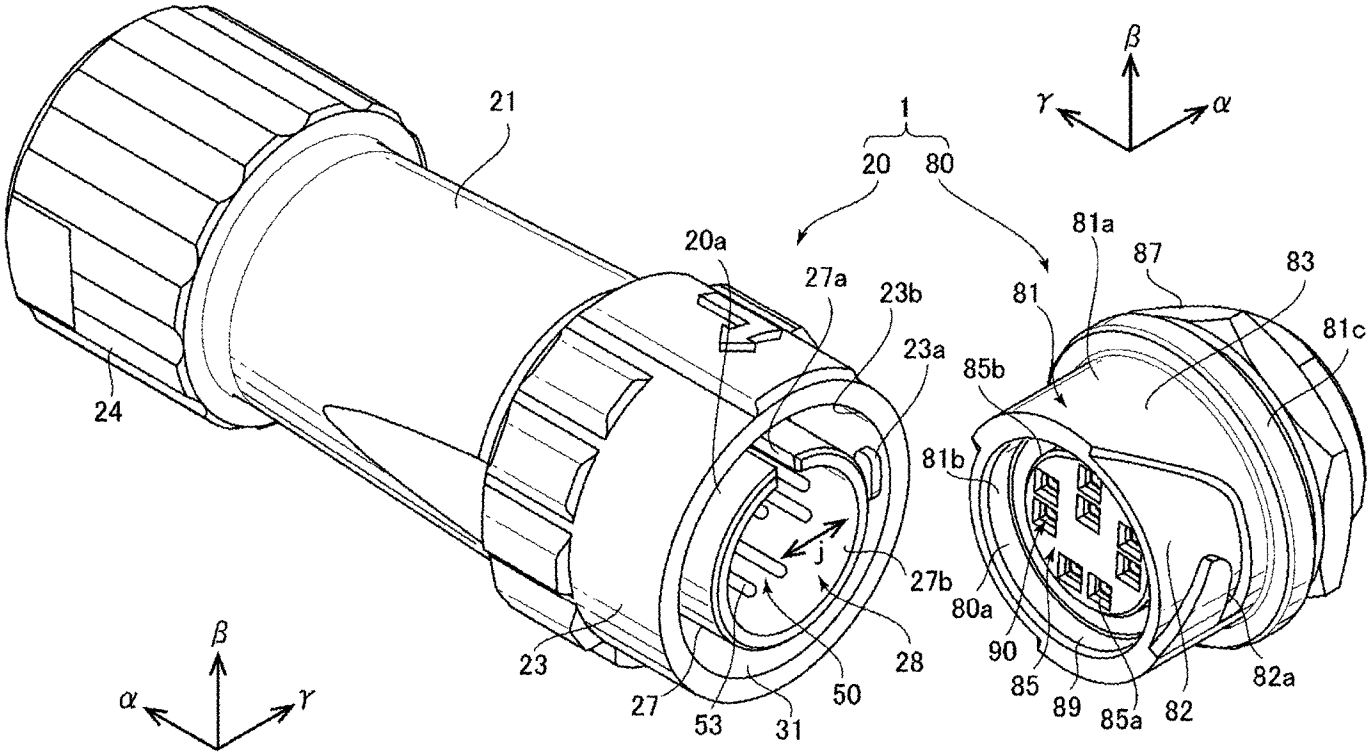
FIG. 1 is a perspective view of a connector device according to an embodiment of the present invention.
Figure 2:
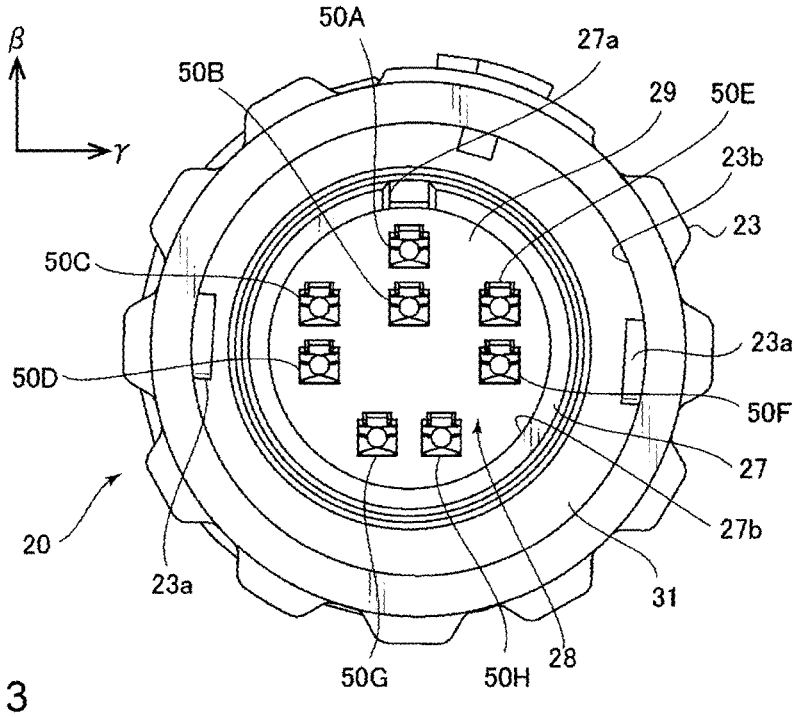
FIG. 2 is a front view of a plug connector, that is, an elevation view of a butt face.
Figure 3:
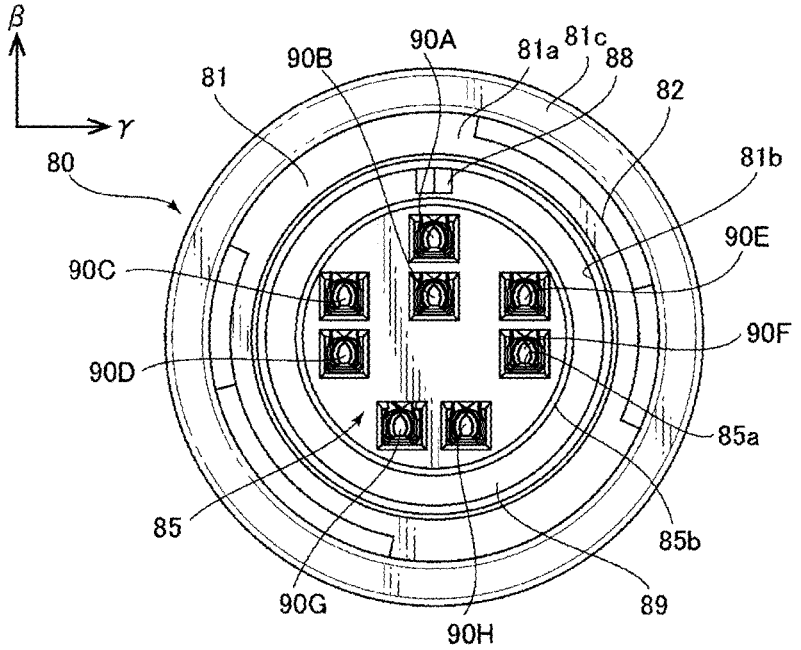
FIG. 3 is a front view of a receptacle connector, that is, an elevation view of a butt face.

FIG. 1 is a perspective view of a connector device 1 according to an embodiment of the present invention. The connector device 1 is composed of a pair of a plug connector 20 and a receptacle connector 80. The plug connector 20 and the receptacle connector 80 mate with one another in an axial direction "a" at front surfaces 20*a* and 80*a* of these connectors, and are connected to one another by bayonet connection. FIGS. 2 and 3 are respectively elevation views of the front surfaces 20*a* and 80*a*, that is, butt faces of the plug connector 20 and the receptacle connector 80.

The plug connector 20 includes a housing 21, an annular coupling member 23, an annular clamping member 24, and a plurality of contacts 50. The housing 21 is a substantially cylindrical cord tube extending in the axial direction "α." The coupling member 23 is fitted on an outer surface of a front part of the housing 21, rotatably relative to the housing 21. The clamping member 24 is fitted on an outer surface of a rear part of the housing 21, rotatably relative to the housing 21. The contacts 50 are inserted through and fixed to the housing 21 in the axial direction "α."

The plug connector 20 and the receptacle connector 80 can be connected to one another by bayonet connection by using the coupling member 23. The coupling member 23 has an inner wall 23*b* provided with a lock protrusion 23*a* that protrudes inward and that is used for retaining the bayonet connection.

At the time of use, a bundle of cables (not illustrated) in which a plurality of twist pair cables are bundled extends rearward of the clamping member 24 in the axial direction "α." By clamping a clamped tool (not illustrated) fixed to the bundle of cables by using the clamping member 24, the bundle of cables can be fixed to the housing 21. The bundle of cables may include, for example, four pairs of twist pair cables (that is, eight cables). The cables are fixed to the contacts 50 via terminal portions (not illustrated) provided at the clamped tool, in a one-to-one correspondence. The cables and the contacts 50 are provided in a state penetrating through the housing 21 in the axial direction "α."

Figure 4:
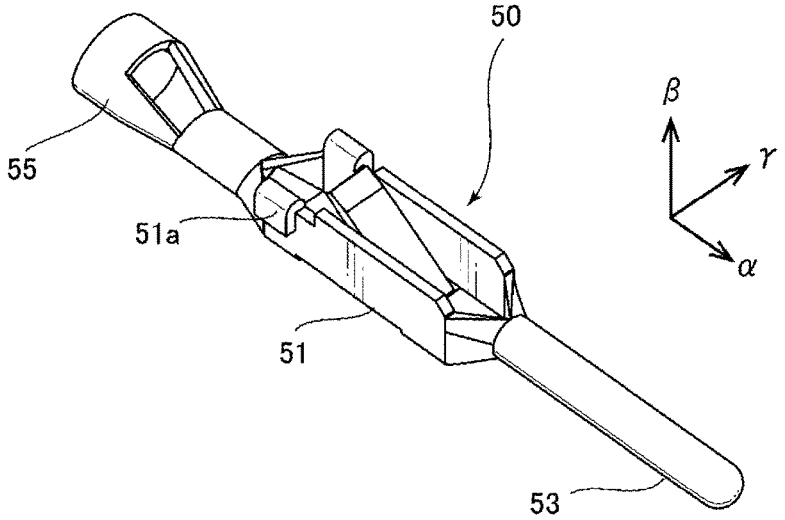
FIG. 4 is a perspective view illustrating an example of a contact of the plug connector.

The eight contacts 50 in total are provided for the four pairs of twist pair cables. All the contacts 50 have the same size and shape. However, the size and shape of the contacts 50 are not limited thereto. FIG. 4 is a perspective view illustrating an example of the contact 50. The contact 50 has a body 51, a pin-shaped contact portion 53 extending forward from the body 51 in the axial direction "α," and a substantially truncated-cone-shaped reception portion 55 provided at a rear end of the body 51. The contact 50 is fixed to a base portion 29 (see FIG. 2) of the housing 21 by using a retaining piece 51*a* provided at a rear end side of the body 51. The base portion 29 has a circular cross section along an orthogonal plane "β-γ" orthogonal to the axial direction "α." The contact portion 53 extends forward in the axial direction "α" in a state standing perpendicularly to the base portion 29. To the reception portion 55, a conductor portion (lead wire) of one cable of the bundle of cables is connected in a one-to-one correspondence. Hence the lead wire of the cable is electrically connected to the contact 50.

A portion of the housing 21 extends forward in the axial direction "α" and forms a substantially cylindrical cover portion 27. Outer peripheries of a plurality of contact portions 53 exposed from the housing 21 are covered with an inner wall 27*b* of the cover portion 27.

A ring-shaped gap 31 is formed between the cover portion 27 and the coupling member 23, in the axial direction "α" and a radial direction "j." When the plug connector 20 and the receptacle connector 80 are connected to one another, the gap 31 is used as a housing space 31 that houses a portion (corresponding to outer frame 83, described later) of a housing 81 of the receptacle connector 80. Also, at the connection, a space 28 defined by the inner wall 27*b* of the cover portion 27 is used as an insertion space 28 into which a portion (corresponding to insertion portion 85, described later) of the receptacle connector 80 is inserted. It is enough to provide the inner wall 27*b* of the cover portion 27 in the insertion direction of the portion (insertion portion 85) so that the inner wall 27*b* can guide the portion (insertion portion 85) to the insertion space 28. The inner wall 27*b* does not have to completely continuously cover the outer peripheries of the contact portions 53.

The receptacle connector 80 includes a housing 81, an annular nut 87, and a plurality of contacts 90. The housing 81 is a holder extending in the axial direction "α." The nut 87 is fitted on an outer surface of a rear part of the housing 81, rotatably relative to the housing 81. The contacts 90 are inserted through and fixed to the housing 81 in the axial direction "α." By sandwiching an attachment body, such as a housing or a panel, between a flange portion 81*c* of the housing 81 and the nut 87, the receptacle connector 80 is attached to the attachment body.

The housing 81 has a ring-shaped outer frame 83 extending forward in the axial direction "α," and a substantially columnar insertion portion 85 extending in parallel to the outer frame 83 in a state surrounded by the outer frame 83. An insertion space 89 is provided between an inner wall 81*b* of the outer frame 83 and an outer wall 85*b* of the insertion portion 85. The cover portion 27 of the plug connector 20 is inserted into the insertion space 89 when the plug connector 20 and the receptacle connector 80 are connected to one another. The insertion portion 85 has contact housing portions 85*a*. The contacts 50 are housed in and fixed to the contact housing portions 85*a*.

The plug connector 20 and the receptacle connector 80 can be connected to one another by bayonet connection by using the outer frame 83. The outer frame 83 has an outer wall 81*a* having a substantially triangular recess 82. The recess 82 is provided with a lock recess 82*a* at a position near a vertex of the substantial triangle, for the lock protrusion 23*a* provided at the coupling member 23 of the plug connector 20. By rotating the coupling member 23, the lock protrusion 23*a* is fitted to the lock recess 82*a*, and hence the connection can be retained.

At the time of use, a bundle of cables (not illustrated) in which a plurality of twist pair cables are bundled extends rearward of the nut 87 in the axial direction "α." The bundle of cables may include, for example, four pairs of twist pair cables (that is, eight cables). Conductor portions (lead wires) of the cables are fixed to the reception portions 95 (see FIG. 5) of the contacts 90 in a one-to-one correspondence. Hence the lead wires of the cables are electrically connected to the contacts 90. The contacts 90 are provided in a state penetrating through the contact housing portions 85*a* provided at the housing 81 in the axial direction "α."

Figure 5:
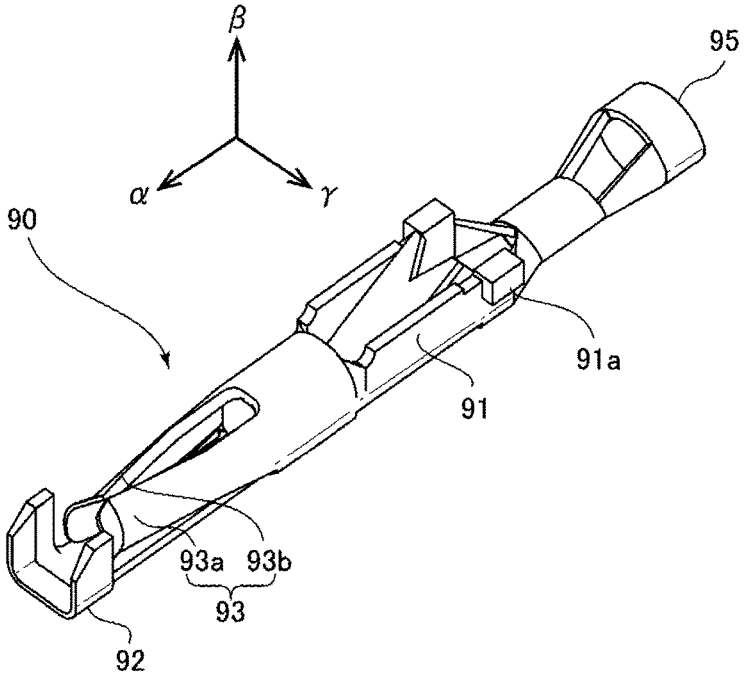
FIG. 5 is a perspective view illustrating an example of a contact of the receptacle connector.

The eight contacts 90 in total are provided for the four pairs of twist pair cables and the contacts 50 of the plug connector 20. All the contacts 90 have the same size and shape. However, the size and shape of the contacts 90 are not limited thereto. FIG. 5 is a perspective view illustrating an example of the contact 90. The contact 90 has a body 91, a fixing piece 92 provided at a front end of the body 91 and having a substantially angular C-shaped cross section, a contact portion 93 extending forward from the body 91 in the axial direction "α," and a substantially truncated-cone-shaped reception portion 95 provided at a rear end of the body 91. A retaining piece 91*a* is provided at a rear end side of the body 91. By using the retaining piece 91*a* and the fixing piece 92, the contact 90 can be fixed to the insertion portion 85 of the housing 81. The contact portion 93 has a pair of sandwiching pieces 93*a* and 93*b*. When the plug connector 20 and the receptacle connector 80 are connected to one another, the pin-shaped contact portion 53 of the contact 50 can be elastically sandwiched by using the sandwiching pieces 93*a* and 93*b*. The contact portion 93 extends from the insertion portion 85 having a circular cross section along the orthogonal plane "β-γ" orthogonal to the axial direction "α," in the axial direction "α" perpendicularly to the cross section.

When the plug connector 20 and the receptacle connector 80 mate with one another, the outer frame 83 of the housing 81 of the receptacle connector 80 is inserted into the housing space 31 formed between the cover portion 27 and the coupling member 23 of the plug connector 20. Also, at this time, the cover portion 27 of the plug connector 20 is inserted into the insertion space 89 formed between the outer frame 83 and the insertion portion 85 of the receptacle connector 80. Further, at this time, the insertion portion 85 of the receptacle connector 80 is inserted into the insertion space 28 defined by using the cover portion 27 of the plug connector 20. The cross section of the insertion space 28 and the cross section of the insertion portion 85 both have substantially circular shapes in the orthogonal plane "β-γ." By inserting the insertion portion 85 of the receptacle connector 80 in which the contacts 90 are arranged is inserted into the insertion space 28 in which the contacts 50 of the plug connector 20 are arranged, the contact portions 53 of the contacts 50 of the plug connector 20 may contact the contact portions 93 of the contacts 90 of the receptacle connector 80 in a one-to-one correspondence. To determine the orientation of the insertion portion 85 with respect to the insertion space 28, a slit 27*a* extending in the axial direction "α" is provided at the cover portion 27, and a protrusion 88 protruding inward is provided at the inner wall 81*b* of the housing 81, correspondingly.

A method of arraying the contacts 50 and 90 in the plug connector 20 and the receptacle connector 80 is described with reference to FIGS. 6 and 7. The drawings correspond to elevation views obtained by extracting only the contacts 50 and 90 in the arrayed state without change from the elevation views illustrated in FIGS. 2 and 3. For the convenience of understanding, FIG. 6 also illustrates the cover portion 27 that defines the insertion space 28, in addition to the contacts 50.

Figure 6:
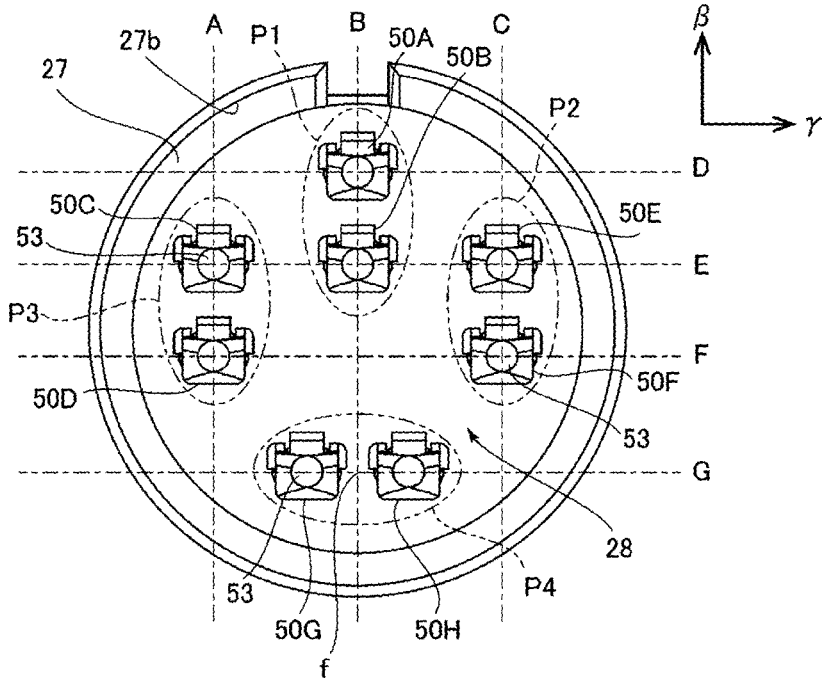
FIG. 6 is an illustration explaining a method of arraying contacts in the plug connector.
Figure 7:
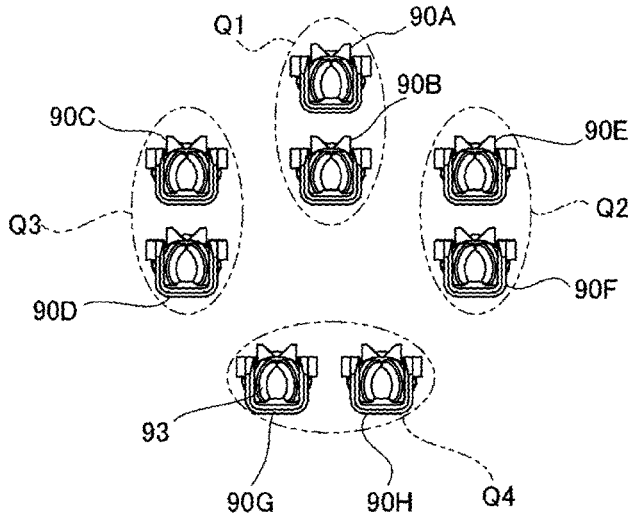
FIG. 7 is an illustration explaining a method of arraying contacts in the receptacle connector.

To effectively reduce the influence of crosstalk, under the findings that it is necessary to separate differential pairs from one another as much as possible in a limited space, and it is necessary to prevent certain differential pairs from being excessively close to one another, the applicant has performed various simulations and has found a preferred arraying method as illustrated in FIGS. 6 and 7. In this case, the eight contacts 50 in total form differential pairs P1 to P4 between adjacent contacts in the insertion space 28 in the orthogonal plane "β-γ" defined by using the cover portion 27. Also, the eight contacts 90 in total form differential pairs Q1 to Q4 between adjacent contacts in the insertion portion 85. As illustrated in FIGS. 6 and 7, the array of the contacts 50 in the plug connector 20 is substantially the same as the array of the contacts 90 in the receptacle connector 80. Hence, the details of the method of arraying terminals is described below with reference to only the plug connector 20. The receptacle connector 80 may be considered similarly to the plug connector 20.

In FIG. 6, it is assumed that vertical lines A to C, and horizontal lines D to G orthogonal to the vertical lines A to C respectively pass through the substantial centers of contacts 50A to 50H, or in other words, substantial centers of the contact portions 53 in the orthogonal plane "β-γ" (referring to FIG. 7, the contacts 90 of the receptacle connector 80 corresponding to the contacts 50A to 50H of the plug connector 20 are denoted as contacts 90A to 90H). As illustrated in FIG. 6, contact portions (53) of contacts (50A, 50B), (50C, 50D), or (50E, 50F) forming each of at least three differential pairs of the differential pairs P1 to P4, for example, each of the differential pairs P1 to P3 arranged along the vertical lines A to C are located in a vertical direction "β" at positions at one side in the vertical direction "β," for example, at positions at the upper side in the orthogonal plane "β-γ," or more particularly, within a plane that defines the insertion space 28 included in the orthogonal plane "β-γ." Also, the differential pairs P1 to P3 are arranged in parallel to one another in a state separated from one another by equal distances in a horizontal direction "γ" in the orthogonal plane "β-γ." In other words, the vertical lines A to C are parallel to one another and the distance A-B is equal to the distance B-C.

In contrast, contact portions (53) of contacts (50G, 50H) forming another differential pair P4 other than the differential pairs P1 to P3 of the differential pairs P1 to P4 are located in the horizontal direction "γ" in the orthogonal plane "β-γ." Further, the contact portions (53) of the contacts (50G, 50H) are located at positions at the other side in the vertical direction "β," for example, at positions at the lower side. In other words, the horizontal line G passing through the contacts 50G and 50H is located at the lower side with respect to the horizontal lines D to F passing through the contacts 50A to 50F.

In this case, the contacts (50A, 50B), (50C, 50D), and (50E, 50F) forming the differential pairs P1 to P3 are separated from one another by equal distances in the vertical direction "β." In other words, for the horizontal lines D to F, the distance D-E and the distance E-F are preferably equal to one another. The distance F-G may be equal to the distance D-E and the distance E-F. However, like the illustrated embodiment, the distance F-G is preferably larger than the distance D-E and the distance E-F.

Also, the differential pairs P2 and P3 located at left and right sides in the horizontal direction "γ" of the differential pairs P1 to P3 are preferably located at the same height in the vertical direction "β." In other words, both the contacts 50C and 50E are preferably present on the horizontal line E, and both the contacts 50D and 50F are preferably present on the horizontal line F.

Further, the differential pair P1 located at the center in the horizontal direction "γ" of the differential pairs P1 to P3 is preferably located at a position at the one side in the vertical direction "β," that is, at a position at the upper side with respect to the differential pairs P2 and P3 located at the left and right sides in the horizontal direction "γ." In other words, the horizontal line D passing through the contact 50A is preferably located at the upper side with respect to the horizontal line E passing through the contacts 50C and 50E.

Furthermore, an imaginary line "B" passing through the contacts (50A, 50B) forming the differential pair P1 located at the center in the horizontal direction "γ" preferably passes through the center "f" in the horizontal direction "γ" of the contacts (50G, 50H) forming the other differential pair P4. That is, the contact 50A or 50B, the contact 50G, and the contact 50H form an isoscales triangle.

Also, the contact (50B) located at a position at the other side in the vertical direction "β," that is, at a position at the lower side of the contacts (50A, 50B) forming the differential pair P1 located at the center in the horizontal direction "γ" is located at the same height as the height of the contacts (50C, 50E) arranged at positions at the one side in the vertical direction "β," that is, at positions at the upper side of the contacts (50C, 50D) and (50E, 50F) respectively forming the differential pairs P2 and P3 located at the left and right sides in the horizontal direction "γ." In other words, the horizontal line E passing through the contact 50B is preferably the same as the horizontal line E passing through the contacts 50C and 50E.

Figure 8:
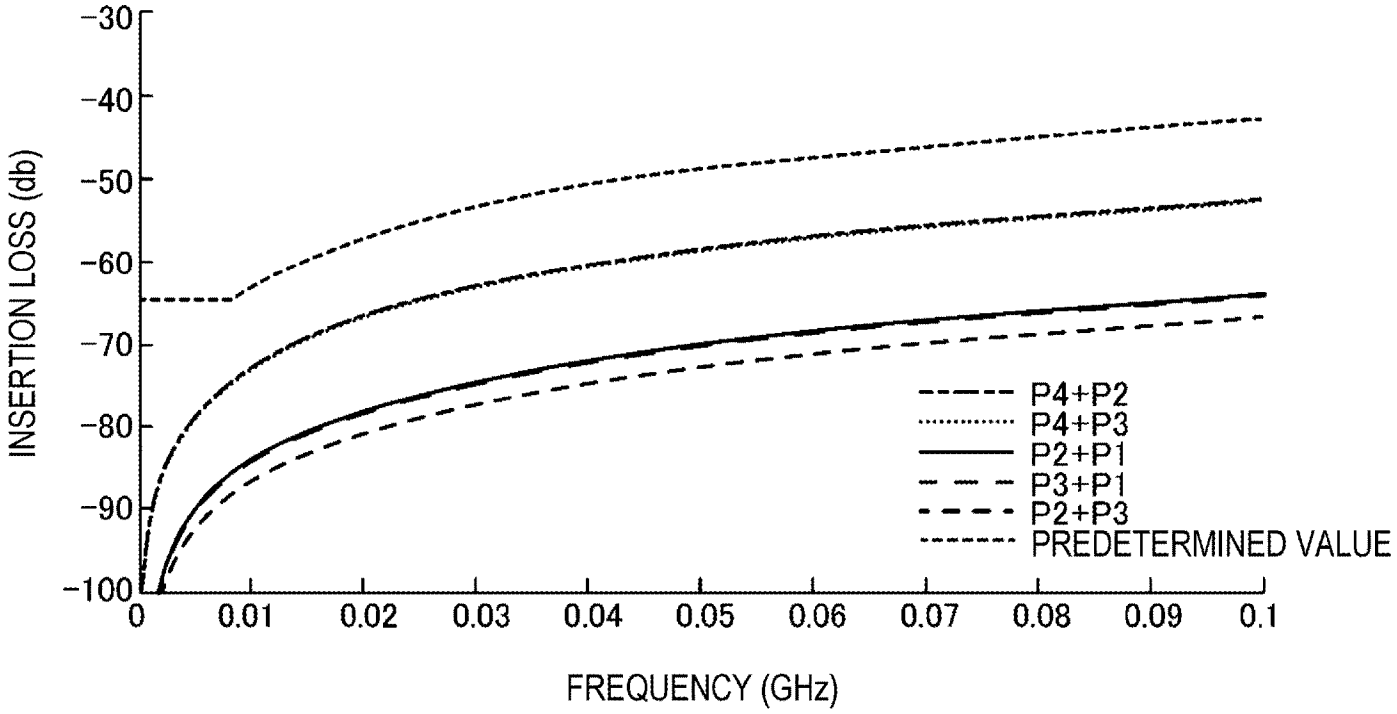
FIG. 8 is an illustration showing an effect of reducing crosstalk, obtained by the configuration of this embodiment.

An effect of reducing crosstalk, obtained by this embodiment is described below with reference to FIG. 8. This illustrates crosstalk that is generated in the plug connector 20 according to an example of this embodiment, or more particularly, crosstalk that is generated between the differential pairs P1 to P4 of the plug connector 20 by simulations. The horizontal axis plots frequency (GHz) and the vertical axis plots insertion loss (dB). "ANSYS HFSS" manufactured by ANSYS, Inc. was used for the simulations. For the condition, the housing 21 of the plug connector 20 and the housing 81 of the receptacle connector 80 used polybutylene terephthalate (PBT) as an assumption. The test standard was based on IEEE 802.3, and it was analyzed whether the insertion loss was smaller than a predetermined value in Category 5e or not. In the graph, for example, "P4+P2" represents insertion loss generated between the differential pair P4 and the differential pair P2. As illustrated in FIG. 8, with this configuration, the insertion loss between any of the differential pairs satisfies (is smaller than) the predetermined value. In the case of "P1+P4," the insertion loss markedly satisfies (is markedly smaller than) the predetermined value. Hence, the insertion loss does not appear in the graph; however, the insertion loss markedly satisfies (is markedly smaller than) the predetermined value. With the present invention, the connector employing the array for effectively reducing the influence of crosstalk for the plurality of contacts forming the differential pairs is provided.

The present invention is not limited to the above-described embodiment, and may be modified in various ways. For example, while the representative contacts used for the four pairs of the twist pair cables are described as an example according to this embodiment, the number of cores used for the connector may vary depending on the standard of the LAN cable. A connector used for twist pair cables other than the four pairs of the twist pair cables can be easily developed by application of the technical scope described in this embodiment. As described above, the present invention can be formed in another different embodiment, and many specific portions thereof can be modified in various obvious viewpoints without departing from the spirit and scope of the present invention. Thus, the drawings and the description are merely examples, and the present invention is not limited thereto.

What is claimed is:

1. A connector comprising:

a plurality of contacts having a plurality of contact portions extending in an axial direction in a one-to-one correspondence; and a housing having an inner wall extending in the axial direction, wherein outer peripheries of the plurality of contact portions are substantially covered with the inner wall, wherein an insertion portion in which a plurality of counterpart contacts capable of contacting the plurality of contact portions in a one-to-one correspondence are arranged is inserted in the axial direction into an insertion space defined by the inner wall, wherein the plurality of contacts form a plurality of differential pairs between adjacent contacts of the plurality of contacts, wherein the adjacent contacts forming each of the differential pairs are relatively closer to each other than to any other of the plurality of contacts, wherein contact portions of contacts of the plurality of contacts forming each of three differential pairs of the plurality of differential pairs are located in a vertical direction at positions at one side in the vertical direction in a plane orthogonal to the axial direction, wherein the three differential pairs are arranged parallel to one another in a state where adjacent ones of said three differential pairs are separated from one another by equal distances in a horizontal direction in the plane orthogonal to the axial direction, and wherein contact portions of contacts of the plurality of contacts forming another differential pair other than the three differential pairs of the plurality of differential pairs are located in the horizontal direction at positions at an other side in the vertical direction in the plane orthogonal to the axial direction, said other side being opposite to said one side.

2. A connector comprising:

a plurality of contacts having a plurality of contact portions extending in an axial direction in a one-to-one correspondence; and a housing having an insertion portion extending in the axial direction, the plurality of contact portions being arranged in the insertion portion, wherein the insertion portion is inserted in the axial direction into an insertion space defined by an inner wall extending in the axial direction to substantially cover outer peripheries of contact portions of a plurality of counterpart contacts capable of contacting the plurality of contact portions in a one-to-one correspondence, wherein the plurality of contacts form a plurality of differential pairs between adjacent contacts of the plurality of contacts, wherein the adjacent contacts forming each of the differential pairs are relatively closer to each other than to any other of the plurality of contacts, wherein contact portions of contacts of the plurality of contacts forming each of three differential pairs of the plurality of differential pairs are located in a vertical direction at positions at one side in the vertical direction in a plane orthogonal to the axial direction, wherein the three differential pairs are arranged parallel to one another in a state wherein adjacent ones of said three differential pairs are separated from one another by equal distances in a horizontal direction in the plane orthogonal to the axial direction, and wherein contact portions of contacts of the plurality of contacts forming another differential pair other than the three differential pairs of the plurality of differential pairs are located in the horizontal direction at positions at an other side in the vertical direction in the plane orthogonal to the axial direction, said other side being opposite to said one side;

and wherein the horizontal direction is perpendicular to said vertical direction;

and wherein contacts of each of the differential pairs of contacts are located relatively closer to each other than to any other contact.

3. The connector according to claim 1, wherein a cross section of the insertion space and a cross section of the insertion portion both have substantially circular shapes in the plane orthogonal to the axial direction.

4. The connector according to claim 2, wherein a cross section of the insertion space and a cross section of the insertion portion both have substantially circular shapes in the plane orthogonal to the axial direction.

5. The connector according to claim 1, wherein the contacts forming each of the three differential pairs are separated from one another by equal distances in the vertical direction.

6. The connector according to claim 2, wherein the contacts forming each of the three differential pairs are separated from one another by equal distances in the vertical direction.

7. The connector according to claim 1, wherein differential pairs located at left and right sides, respectively, in the horizontal direction of the three differential pairs are located at a same height in the vertical direction.

8. The connector according to claim 2, wherein differential pairs located at left and right sides, respectively, in the horizontal direction of the three differential pairs are located at a same height in the vertical direction.

9. The connector according to claim 1, wherein a differential pair located at a center in the horizontal direction of the three differential pairs is located at a position at the one side in the vertical direction with respect to differential pairs located at left and right sides, respectively, in the horizontal direction of the three differential pairs.

10. The connector according to claim 2, wherein a differential pair located at the center in the horizontal direction of the three differential pairs is located at a position at the one side in the vertical direction with respect to differential pairs located at left and right sides, respectively, in the horizontal direction of the three differential pairs.

11. The connector according to claim 1, wherein an imaginary line passing through centers of contacts of the plurality of contacts forming a differential pair located at a center in the horizontal direction of the three differential pairs passes through a center in the horizontal direction of the contacts forming the another differential pair.

12. The connector according to claim 2, wherein an imaginary line passing through centers of contacts of the plurality of contacts forming a differential pair located at a center in the horizontal direction of the three differential pairs passes through a center in the horizontal direction of the contacts forming the another differential pair.

13. The connector according to claim 1, wherein a contact located at a position at the other side in the vertical direction of contacts of the plurality of contacts forming a differential pair located at the center in the horizontal direction of the three differential pairs is located at a same height in the vertical direction as a height of a contact arranged at a position at the one side in the vertical direction of contacts of the plurality of contacts forming each of differential pairs located at left and right sides, respectively, in the horizontal direction of the three differential pairs.

14. The connector according to claim 2, wherein a contact located at a position at the other side in the vertical direction of contacts of the plurality of contacts forming a differential pair located at a center in the horizontal direction of the three differential pairs is located at the same height in the vertical direction as a height of a contact arranged at a position at the one side in the vertical direction of contacts of the plurality of contacts forming each of differential pairs located at left and right sides, respectively, in the horizontal direction of the three differential pairs.

15. The connector according to claim 1, wherein the contacts are contacts compliant with Category 5e and are eight in total.

16. The connector according to claim 2, wherein the contacts are contacts compliant with Category 5e and are eight in total.

17. A connector device comprising a first connector and a second connector, said first connector comprising:

a plurality of first contacts having a plurality of first contact portions extending in an axial direction in a one-to-one correspondence; and a first housing having a first inner wall extending in the axial direction, wherein outer peripheries of the plurality of first contact portions are substantially covered with the first inner wall, wherein a first insertion portion in which a plurality of first counterpart contacts capable of contacting the plurality of first contact portions in a one-to-one correspondence are arranged is inserted in the axial direction into a first insertion space defined by the first inner wall, wherein the plurality of first contacts form a plurality of first differential pairs between adjacent contacts of the plurality of first contacts, wherein the adjacent contacts forming each of the first differential pairs are relatively closer to each other than to any other of the plurality of first contacts, wherein first contact portions of contacts of the plurality of first contacts forming each of three first differential pairs of the plurality of first differential pairs are located in a vertical direction at positions at one side in the vertical direction in a plane orthogonal to the axial direction, wherein the three first differential pairs are arranged in parallel to one another in a state wherein adjacent ones of said three first differential pairs are separated from one another by equal distances in a horizontal direction in the plane orthogonal to the axial direction, and wherein first contact portions of contacts of the plurality of first contacts forming another first differential pair other than the three first differential pairs of the plurality of first differential pairs are located in the horizontal direction at positions at an other side in the vertical direction in the plane orthogonal to the axial direction; and said second connector comprising:

a plurality of second contacts having a plurality of second contact portions extending in an axial direction in a one-to-one correspondence; and a second housing having a second insertion portion extending in the axial direction, the plurality of second contact portions being arranged in the second insertion portion, wherein the second insertion portion is inserted in the axial direction into an second insertion space defined by a second inner wall extending in the axial direction to substantially cover outer peripheries of a plurality of second counterpart contacts contact portions that are capable of contacting the plurality of second contact portions in a one-to-one correspondence, wherein the plurality of second contacts form a plurality of second differential pairs between adjacent contacts of the plurality of second contacts, wherein the adjacent contacts forming each of the second differential pairs are relatively closer to each other than to any other of the plurality of second contacts, wherein second contact portions of contacts of the plurality of second contacts forming each of three second differential pairs of the plurality of second differential pairs are located in a vertical direction at positions at one side in the vertical direction in a plane orthogonal to the axial direction, wherein the three second differential pairs are arranged in parallel to one another in a state wherein adjacent ones of said three second differential pairs are separated from one another by equal distances in a horizontal direction in the plane orthogonal to the axial direction, and wherein second contact portions of contacts of the plurality of second contacts forming another second differential pair other than the three second differential pairs of the plurality of second differential pairs are located in the horizontal direction at positions at the other side in the vertical direction in the plane orthogonal to the axil direction.

18. The connector device according to claim 17, wherein a cross section of the insertion space and a cross section of the insertion portion are both substantially circular in shape in the orthogonal plane.

* * * * *